US005360493A

United States Patent [19]

Matsuoka et al.

[11] Patent Number: 5,360,493

[45] Date of Patent: Nov. 1, 1994

[54] HIGH-STRENGTH COLD-ROLLED STEEL SHEET EXCELLING IN DEEP DRAWABILITY AND METHOD OF PRODUCING THE SAME

[75] Inventors: Saiji Matsuoka; Hidetaka Kawabe; Eiko Yasuhara; Kei Sakata; Toshiyuki Kato, all of Chiba, Japan

[73] Assignee: Kawasaki Steel Corporation, Kobe, Japan

[21] Appl. No.: 72,725

[22] Filed: Jun. 7, 1993

[30] Foreign Application Priority Data

| | | | |
|---|---|---|---|
| Jun. 8, 1992 | [JP] | Japan | 4-147488 |
| Jun. 8, 1992 | [JP] | Japan | 4-147606 |
| Jun. 8, 1992 | [JP] | Japan | 4-147607 |
| Jun. 22, 1992 | [JP] | Japan | 4-162912 |
| Aug. 18, 1992 | [JP] | Japan | 4-219198 |
| Jan. 8, 1993 | [JP] | Japan | 5-001878 |
| Jan. 26, 1993 | [JP] | Japan | 5-010858 |

[51] Int. Cl.[5] ..... C21D 8/04; C22C 38/06; C22C 38/12

[52] U.S. Cl. ..... 148/320; 148/661; 148/651; 148/653

[58] Field of Search ..... 148/661, 651, 653, 320

[56] References Cited

U.S. PATENT DOCUMENTS 4,576,657 3/1986 Satoh et al. ..... 148/653
5,041,166 8/1991 Matsuoka et al. ..... 148/651

FOREIGN PATENT DOCUMENTS 56-166328 12/1981 Japan ..... 148/661

*Primary Examiner*—Deborah Yee
*Attorney, Agent, or Firm*—Dvorak and Traub

[57] ABSTRACT

In a method of producing a high-strength cold-rolled steel sheet excelling in deep drawability, a steel material is used which consists of: a basic composition including 0.01% or less of C, 0.1 to 2.0% of Si, 0.5 to 3.0% of Mn, 0.02 to 0.2% of P, 0.05% or less of S, 0.03 to 0.2% of Al, 0.01% or less of N, 0.001 to 0.2% of Nb, and 0.0001 to 0.008% of B in such a way that the respective contents of C, Nb, Al, N, Si, Mn and P satisfy the following formulae:

$5 \leqq Nb/C \leqq 30$, $10 \leqq Al/N \leqq 80$, and $16 \leqq (3 \times Si/28 + 200 \times P/31)/(Mn/55) \leqq 40$; Fe remnant; and inevitable impurities, the method including the steps of:

performing rolling on the steel material with a total reduction of 50% or more and 95% or less while effecting lubrication thereon in a temperature range of not higher than the $Ar_3$ transformation temperature and not lower than 500° C.;

performing a hot-rolled sheet recrystallization treatment on the steel material by a coiling or annealing process;

performing cold rolling on the steel material with a reduction of 50 to 95%; and then effecting recrystallization annealing on the steel material in a temperature range of 700 ° to 950° C.

20 Claims, 9 Drawing Sheets

HIGH-STRENGTH COLD-ROLLED STEEL SHEET EXCELLING IN DEEP DRAWABILITY AND METHOD OF PRODUCING THE SAME

BACKGROUND OF THE INVENTION

1. Field of the Invention

This invention relates to a method of producing a high-strength cold-rolled steel sheet excelling in deep drawability and ductility and suitable for use in automobiles, etc.

2. Description of the Related Art

As a result of the desire to increase the quality of automobiles, the cold-rolled steel sheets used in automobiles are now required to have certain properties not previously required.

For example, there is a strong tendency to reduce the weight of the car body to attain a reduction in fuel consumption and, at the same time, to use a stronger steel sheet having a tensile strength of, for example, 35~65 kgf/mm$^2$, in order to ensure the requisite safety for the occupants of the automobile.

A cold-rolled steel sheet to be used as a panel, etc. in an automobile must have an excellent deep drawability. To improve the deep drawability of a steel sheet, it is necessary for the mechanical properties of the steel sheet to be such as to exhibit a high r-value (Lankford value) and high ductility (El).

The assembly of a car body has been conventionally performed by joining together a large number of pressed-worked parts by spot welding. In recent years, there has been an increasing demand to enlarge some of these parts or convert them into integral units so as to reduce the number of separate parts and welding operations performed.

For example, the oil pan of an automobile has to be completed by welding because of its complicated configuration. But, the automobile manufactures have a strong desire to produce such a component as an integral unit. Further, to meet the increasing diversification in the needs of consumers, the design of cars has become more and more complicated, resulting in an increase in the number of parts which are difficult to form out of conventional steel sheets. To meet such demands, it is necessary to provide a cold-rolled steel sheet which is much superior to the conventional steel sheets in terms of deep drawability.

Thus, although a steel sheet for an automobile must be very strong, it is required, at the same time, to exhibit an excellent deep drawability in press working. In view of this, a study is being made with a view to developing a steel sheet which has a high level of strength and which, at the same time, exhibits a r-value equal to or higher than those of the conventional steel sheets and also, excellent ductility.

A number of methods for producing cold-rolled steel sheets satisfying the above requirements have been proposed.

Japanese Patent Laid-Open No. 64-28325 discloses a method for producing high-strength cold-rolled steel sheets according to which an ultra-low-carbon steel containing Ti-Nb and, as needed, B, is subjected to recrystallization in the ferrite region after hot rolling; then, cold rolling is performed and, further, recrystallization annealing is conducted. However, although in this method an attempt is made to attain a high level of strength through addition of Si, Mn and P, the amount of these additives is not enough. Further, because of the large amount of Ti added, a phosphide of Ti is formed in great quantities, so that the r-value obtained is rather low; and the product of the tensile strength and the r-value (TS×r) is 102 or less, which indicates an insufficient level of deep drawability.

Japanese Patent Laid-Open No. 2-47222 discloses a method of producing high-strength cold-rolled steel sheets according to which an ultra-low-carbon Ti-containing steel containing some B, as needed, is subjected to hot rolling in the ferrite region and then to recrystallization; after that, it is subjected to cold rolling, and then to recrystallization annealing. Although this method enables a high r-value to be obtained, the contents of solute reinforcement elements Si, Mn and P are 0.04 wt % or less, 0.52 wt % or less, and 0.023 wt % or less, respectively. Because of these low contents of the reinforcement elements, it is impossible to obtain a high strength of 35 kgf/mm$^2$. Nor does this prior-art technique suggest any method for producing a high-strength cold-rolled steel sheet having a tensile strength of 35 kgf/mm$^2$ or more.

Japanese Patent Laid-Open No. 3-199312 discloses a method of producing high-strength cold-rolled steel sheets according to which an ultra-low-carbon Ti-containing steel with some B, is subjected to hot rolling and then to cold rolling; after that it is subjected to recrystallization. The problem with this method is that it uses a steel containing a large amount of Ti, which is not affected by a hot-rolled sheet recrystallization process, with the result that the r-value obtained is rather low, the product of the tensile strength and the r-value (TS×r) being less than 105. Thus, the method does not provide a sufficient level of deep drawability.

SUMMARY OF THE INVENTION

This invention has been made with a view toward solving the above problems in an advantageous manner. It is an object of this invention to provide a method of producing a high-strength cold-rolled steel sheet whose tensile strength is 35 kgf/nun$^2$ or more, which is by far superior to the conventional steel sheets in deep drawability, and which also excels in ductility.

After applying themselves closely to the study of such a production method, with a view to achieving an improvement in deep drawability and ductility, the inventors in this case have found that it is possible to produce a high-strength cold-rolled steel sheet whose tensile strength is 35 kgf/mm$^2$ or more, which is by far superior to the conventional steel sheets in deep drawability, and which also excels in ductility by appropriately specifying the steel composition and the production conditions, thus achieving the present invention.

In accordance with this invention, (1) The relationship between Si, Mn and P is specified so as to ensure a high strength level of 35 kgf/mm$^2$ or more, without involving a deterioration in the r-value.

(2) In order to restrain the generation of (Fe,Ti)P compounds leading to a degeneration in the r-value, no Ti is added or the amount of solute Ti is determined in accordance with the P content.

(3) Further, the rolling and annealing conditions for the steel of the composition of the above (1) and (2) are specified.

(4) In accordance with the above (1), (2) and (3), it is possible to obtain a high-strength cold-rolled steel sheet in which the product of the r-value (Lankford value) and the TS (tensile strength: kgf/mm$^2$) is 105 or more.

In accordance with the present invention, there is provided a method for producing a high-strength cold-rolled steel sheet which excels in deep drawability by using a steel material consisting of: a basic composition including 0.01% or less of C, 0.1 to 2.0% of Si, 0.5 to 3.0% of Mn, 0.02 to 0.2% of P, 0.05% or less of S, 0.03 to 0.2% of Al, 0.01% or less of N, 0.001 to 0.2% of Nb, and 0.0001 to 0.008% of B in such a way that the respective contents of C, Nb, Al, N, Si, Mn and P satisfy the following formulae:

$5 \leqq Nb/C \leqq 30$, $10 \leqq Al/N \leqq 80$, and $16 \leqq (3 \times Si/28 + 200 \times P/31)/(Mn/55) \leqq 40$; Fe remnant; and inevitable impurities, the method comprising the steps of:

performing rolling on the steel material with a total reduction of 50% or more and 95% or less while applying lubrication in a temperature range of not more than an $Ar_3$ transformation temperature and not less than 500° C.;

performing a hot-rolled sheet recrystallization treatment on the steel material by a coiling or annealing process;

performing cold rolling on the steel material with a reduction of 50 to 95%; and then recrystallization annealing of the steel material in a temperature range of 700° to 950° C.

Further, the present invention allows addition of various elements insofar as they do not interfere with the special benefits of this invention, thereby making it possible to obtain a further improved steel.

Other features of the present invention will become apparent along with some variations thereof through the following detailed description.

DESCRIPTION OF THE PREFERRED EMBODIMENTS

First, the results of investigations on the basis of which the present invention has been achieved will be described.

Figure 1:
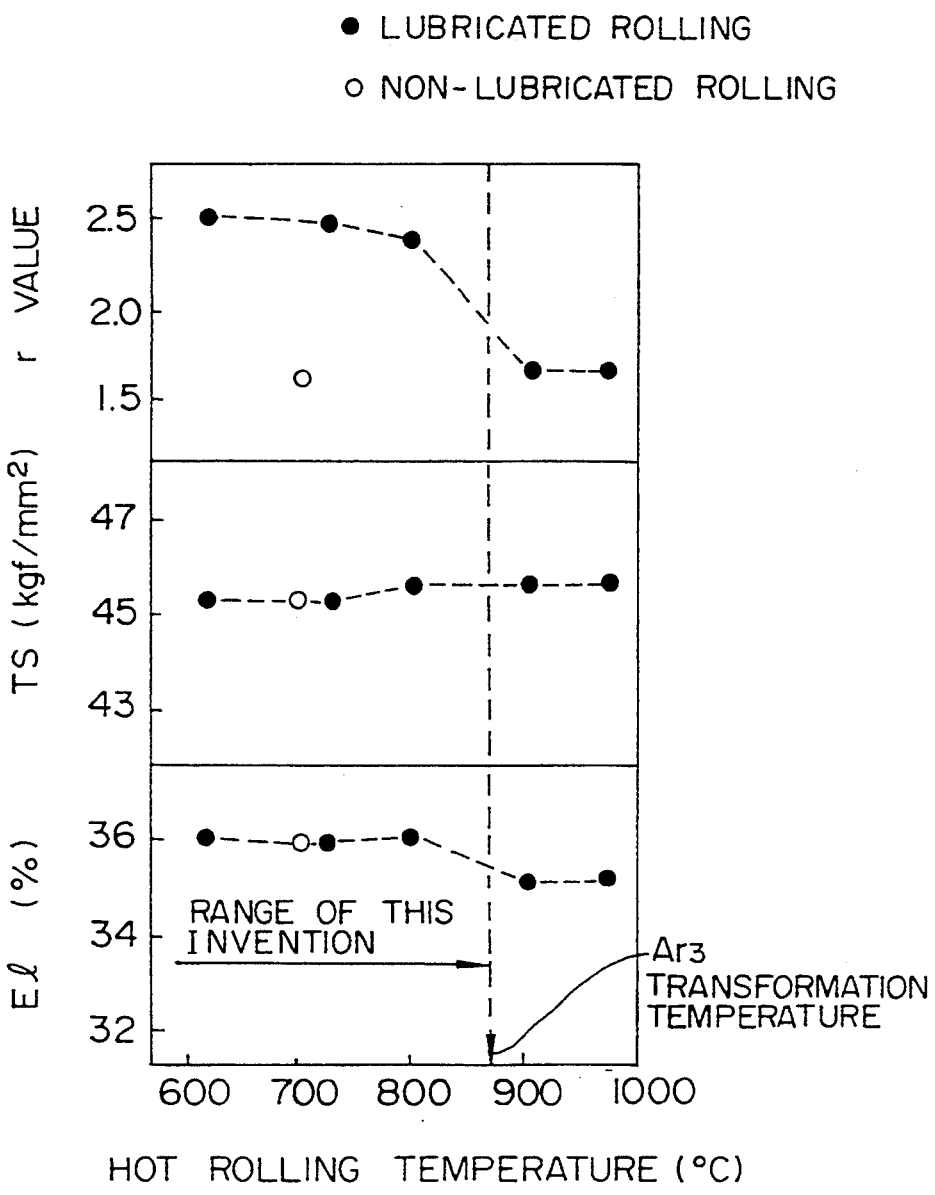
FIG. 1 is a graph showing the influence of hot-rolling temperature and lubrication in hot rolling on the r-value, TS (tensile strength) and El (elongation) of a cold-rolled steel sheet.

A slab having a composition including 0.002% of C, 1.0% of Si, 1.0% of Mn, 0.05% of P, 0.005% of S, 0.05% of Al, 0.002% of N, 0.03% of Nb, and 0.0010% of B was subjected to heating/soaking at a temperature of 1150° C., and then to hot rolling at a finish hot-rolling temperature of 620° to 980° C. Subsequently, the hot-rolled sheet was subjected to recrystallization annealing at 750° C. for 5 hours. After that, it was cold-rolled with a reduction of 75%, and then subjected to recrystallization annealing at 890° C. for 20 seconds. FIG. 1 shows the influence of the hot-rolling temperature and lubrication on the r-value, TS and El after the cold-rolling/annealing. As is apparent from FIG. 1, the r-value and El after the cold-rolling/annealing depend upon the hot-rolling temperature and lubrication; it has been found that by performing lubrication rolling at a hot-rolling temperature of $Ar_3$ or less, it is possible to obtain a high r-value and a high level of El.

Figure 2:
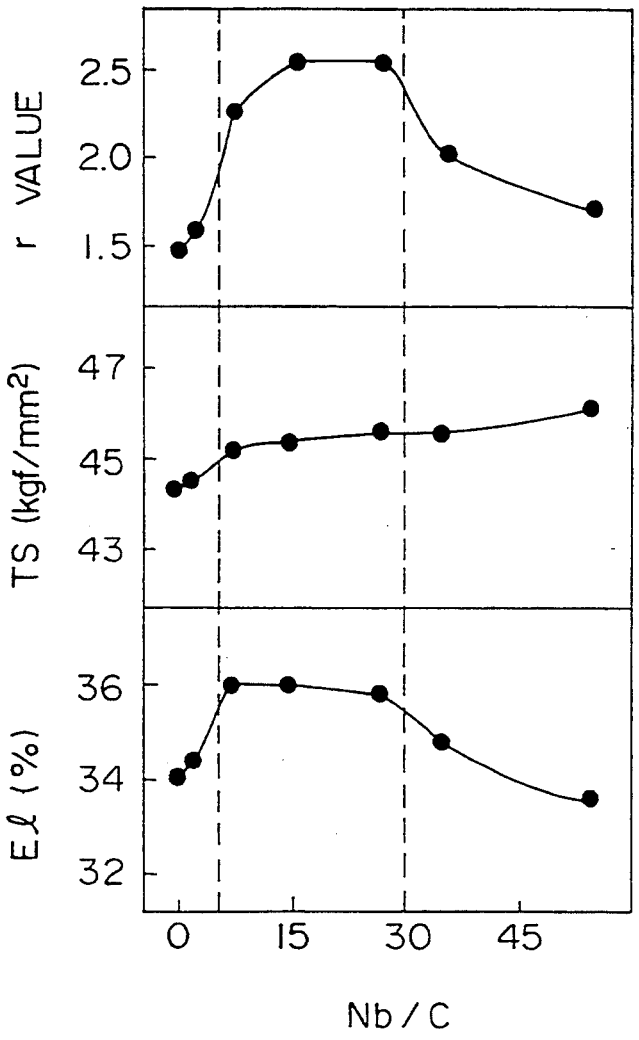
FIG. 2 is a graph showing the influence of Nb content on the r-value, TS (tensile strength) and El (elongation) of a cold-rolled steel sheet as investigated in terms of weight ratio with respect to C.

A slab having a composition including 0.002% of C, 1.0% of Si, 1.0% of Mn, 0.05% of P, 0.005% of S, 0.05% of Al, 0.002% of N, 0 to 0.10% of Nb, and 0.0010% of B was subjected to heating/soaking at a temperature of 1150° C., and then to lubrication rolling at a finish hot-rolling temperature of 700° C. Subsequently, the hot-rolled sheet was subjected to recrystallization annealing at 750° C. for 5 hours. After that, it was cold-rolled with a reduction of 75%, and then subjected to recrystallization annealing at 890° C. for 20 seconds. FIG. 2 shows the influence of the steel components on the r-value, TS and El after the cold-rolling-/annealing. As is apparent from FIG. 2, the r-value and El after the cold-rolling/annealing depend upon the steel components; it has been found that by setting the steel composition in such a way as to satisfy the formula: $5 \leqq Nb/C \leqq 30$, it is possible to obtain a high r-value and a high level of El.

Figure 3:
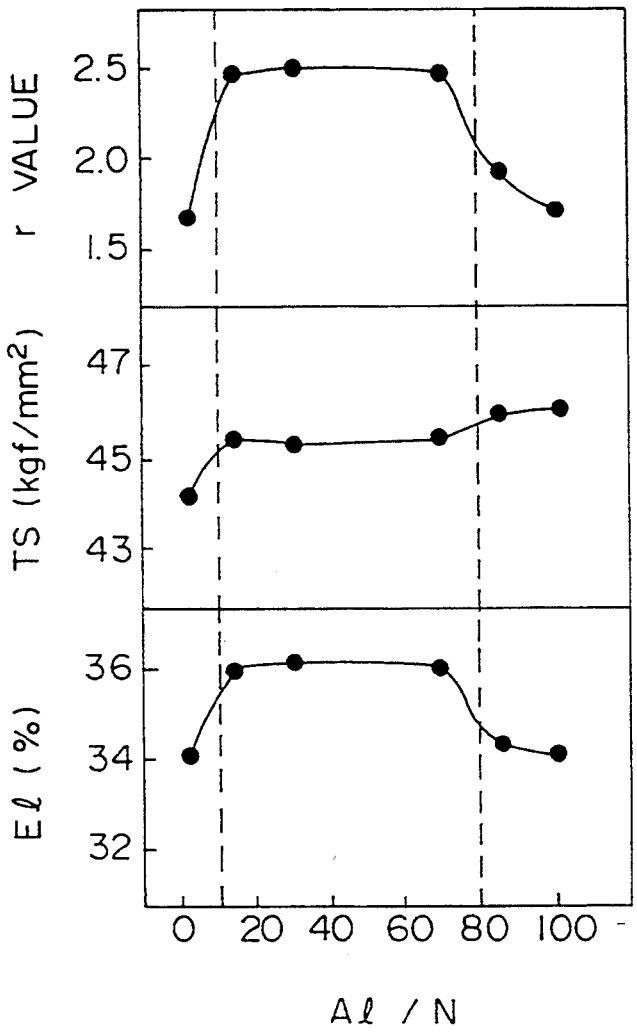
FIG. 3 is a graph showing the influence of Al content on the r-value, TS (tensile strength) and El (elongation) of a cold-rolled steel sheet as investigated in terms of weight ratio with respect to N.

A slab having a composition including 0.002% of C, 1.0% of Si, 1.0% of Mn, 0.05% of P, 0.005% of S, 0.01 to 0.02% of Al, 0.002% of N, 0.03% of Nb, and 0.0010% of B was subjected to heating/soaking at a temperature of 1150° C., and then to lubrication rolling at a finish hot-rolling temperature of 700° C. Subsequently, the hot-rolled sheet was subjected to recrystallization annealing at 750° C. for 5 hours. After that, it was cold-rolled with a reduction of 75%, and then subjected to recrystallization annealing at 890° C. for 20 seconds. FIG. 3 shows the influence of the steel components on the r-value, TS and El after the cold-rolling-/annealing. As is apparent from FIG. 3, the r-value and El after the cold-rolling/annealing depend upon the steel components; it has been found that by setting the steel composition in such a way as to satisfy the formula: $10 \leqq Al/N \leqq 80$, it is possible to obtain a high r-value and a high level of El.

A slab having a composition including 0.002% of C, 0.1 to 1.5% of Si, 0.5 to 3.0% of Mn, 0.02 to 0.20% of P, 0.005% of S, 0.05% of Al, 0.002% of N, 0.03% of Nb, and 0.0030% of B was subjected to heating/soaking at a temperature of 1150° C., and then to lubrication rolling at a finish hot-rolling temperature of 700° C..

Figure 4:
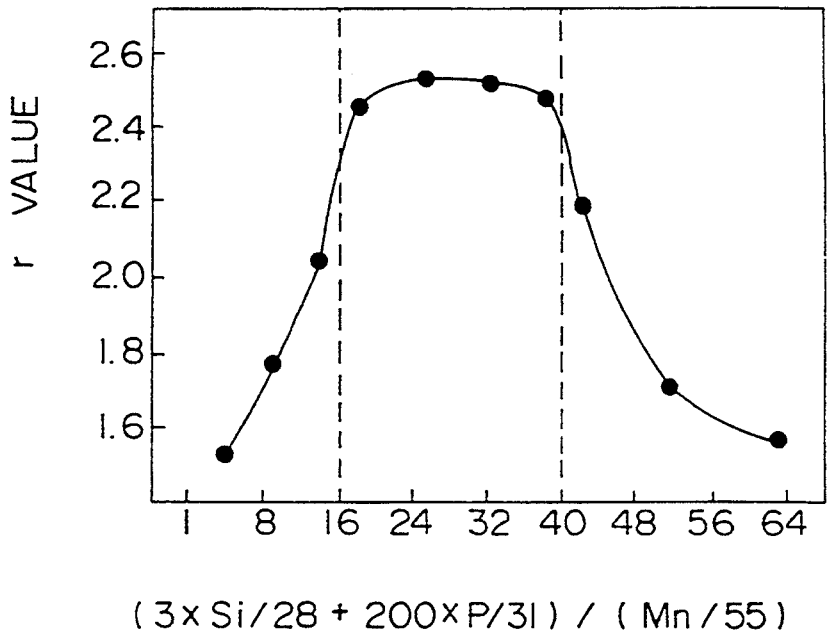
FIG. 4 is a graph showing the influence of Si, Mn and P contents on the r-value of a cold-rolled steel sheet.

Subsequently, the hot-rolled sheet was subjected to recrystallization annealing at 850° C. for 20 seconds. After that, it was cold-rolled with a reduction of 75%, and then subjected to recrystallization annealing under the conditions of 890° C. and 20 seconds. FIG. 4 shows the influence of the added amounts of Si, Mn and P on the r-value after the cold-rolling/annealing. As is apparent from FIG. 4, the r-value after the cold-rolling/annealing depends upon the added amounts of Si, Mn and P; it has been found that by setting the steel composition in such a way as to satisfy the formula: $16 \leqq (3 \times Si/28 + 200 \times P/31)/(Mn/55) \leqq 40$, it is possible to obtain a high r-value.

Figure 5:
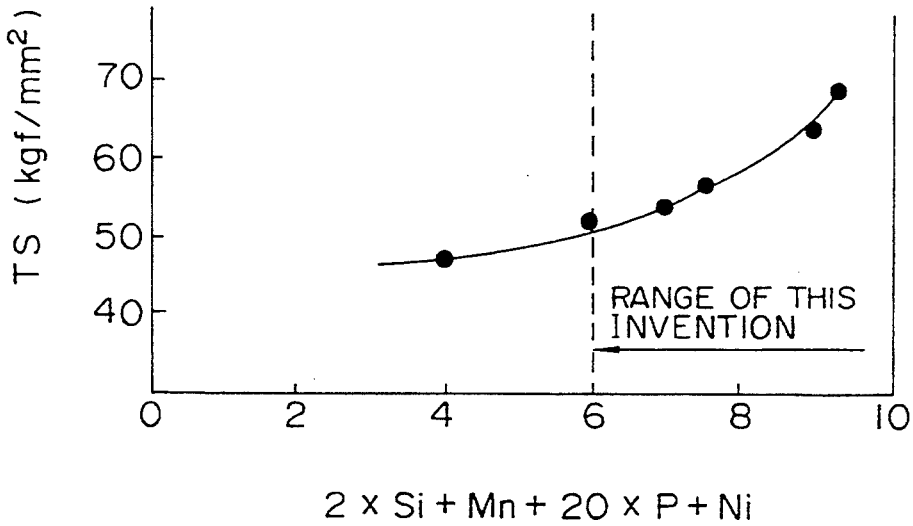
FIG. 5 is a graph showing the influence of Si, Mn, P and Ni contents on the TS (tensile strength) of a cold-rolled steel sheet.

A steel slab having a composition including 0.002% of C, 0.5 to 2.0% of Si, 0.5 to 3.0% of Mn, 0.02 to 0.15% of P, 0.005 wt % of S, 0.05% of Al, 0.002% of N, 0.1 to 1.5% of Ni, 0.025% of Nb, and 0.003 wt % of B was subjected to heating/soaking at a temperature of 1150° C., and then to lubrication rolling at a finish hot-rolling temperature of 700° C. Subsequently, the hot-rolled sheet obtained was subjected to recrystallization annealing at 850° C. for 20 seconds, at a heating rate of 10° C./s. After that, it was cold-rolled with a reduction of 75%, and then subjected to recrystallization annealing at 850° C. for 20 seconds. FIG. 5 shows the influence of the steel components on the TS (tensile strength) of the cold-rolled steel sheet thus obtained. As is apparent from FIG. 5, it has been found that through a composition expressed as: $X = 2 \times Si + Mn + 20 \times P + Ni \geqq 6$, it is possible to obtain a TS which is not less than 50 $kgf/mm^2$.

Figure 6:
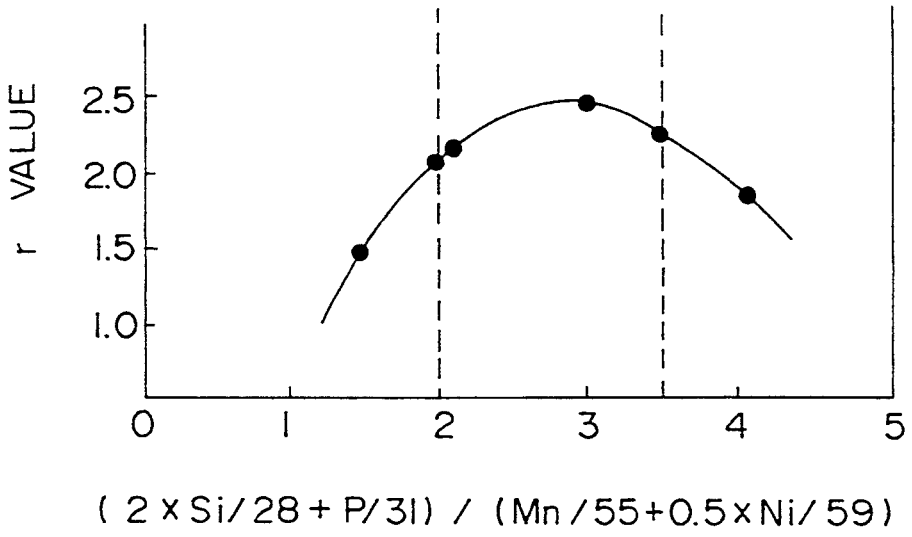
FIG. 6 is a graph showing the influence of Si, Mn, P and Ni contents on the r-value of a cold-rolled steel sheet.

A steel slab having a composition including 0.002 wt % of C, 1.0 to 2.0 wt % of Si, 1.5 to 3.0 wt % of Mn, 0.05 to 0.15 wt % of P, 0.005 wt % of S, 0.05 wt % of Al, 0.002 wt % of N, 0.1 to 1.5 wt % of Ni, 0.003 wt % of B, 0.025 wt % of Nb, and $X = 2 \times Si + Mn + 20 \times P + Ni \geqq 6$ was subjected to heating/soaking at a temperature of 1150° C., and then to lubrication rolling at a finish hot-rolling temperature of 700° C. Subsequently, the hot-rolled sheet obtained was subjected to recrystallization annealing at 850° C. for 20 seconds, at a heating rate of 10° C./s. After that, it was cold-rolled with a reduction of 75%, and then subjected to recrystallization annealing at 850° C. for 20 seconds. FIG. 6 shows the influence of the steel components on the r-value of the cold-rolled steel sheet thus obtained. As is apparent from FIG. 6, it has been found that through composition expressed as: $Y = (2 \times Si/28 + P/31)/(Mn/55 + 0.5 \times Ni/59)$, and $Y = 2.0$ to 3.5, it is possible to obtain an r-value which is not less than 2.0.

Figure 7:
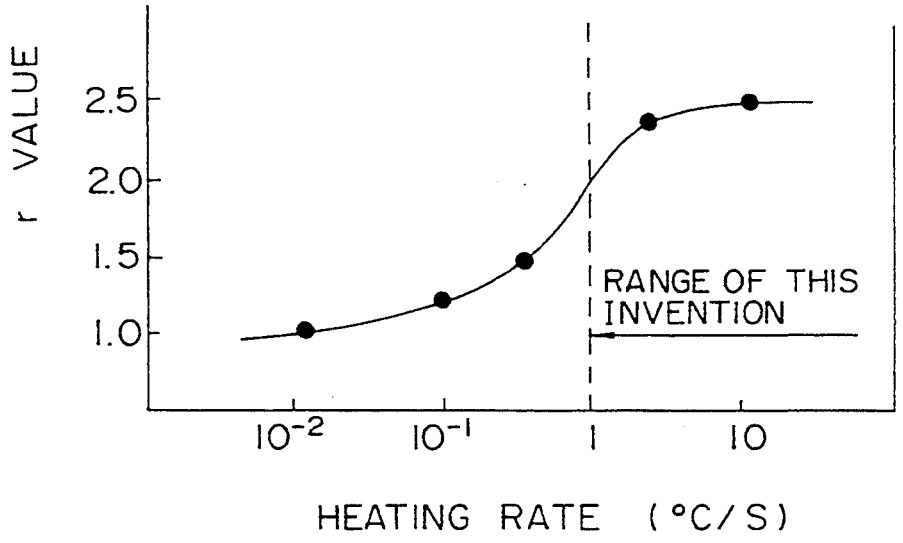
FIG. 7 is a graph showing the influence of hot-rolled sheet heating rate on the r-value of a cold-rolled steel sheet.

A steel slab having a composition including 0.002 wt % of C, 1.5 wt % of Si, 2.0 wt % of Mn, 0.10 wt % of P, 0.005 wt % of S, 0.05 wt % of Al, 0.002 wt % of N, 0.5 wt % of Ni, 0.003 wt % of B, 0.025 wt % of Nb, $X = 2 \times Si + Mn + 20 \times P + Ni = 7.5$, and $Y = (2 \times Si/28 + P/31)/(Mn/55 + 0.5 \times Ni/59) = 2.7$ was subjected to heating/soaking at a temperature of 1150° C., and then to lubrication rolling at a finish hot-rolling temperature of 700° C. Subsequently, the hot-rolled sheet obtained was subjected to recrystallization annealing at 850° C. gfor 20 seconds, at a heating rate of 0.01 to 30° C./s. After that, it was cold-rolled with a reduction of 75%, and then subjected to recrystallization annealing at 850° C. for 20 seconds. FIG. 7 shows the influence of the heating rate on the r-value of the cold-rolled steel sheet thus obtained. As is apparent from FIG. 7, the r-value depends upon the heat-rolled-sheet heating rate; it has been found that by setting the heating rate at a level not lower than 1° C./s, it is possible to obtain an r-value which is not less than 2.0.

Figure 8:
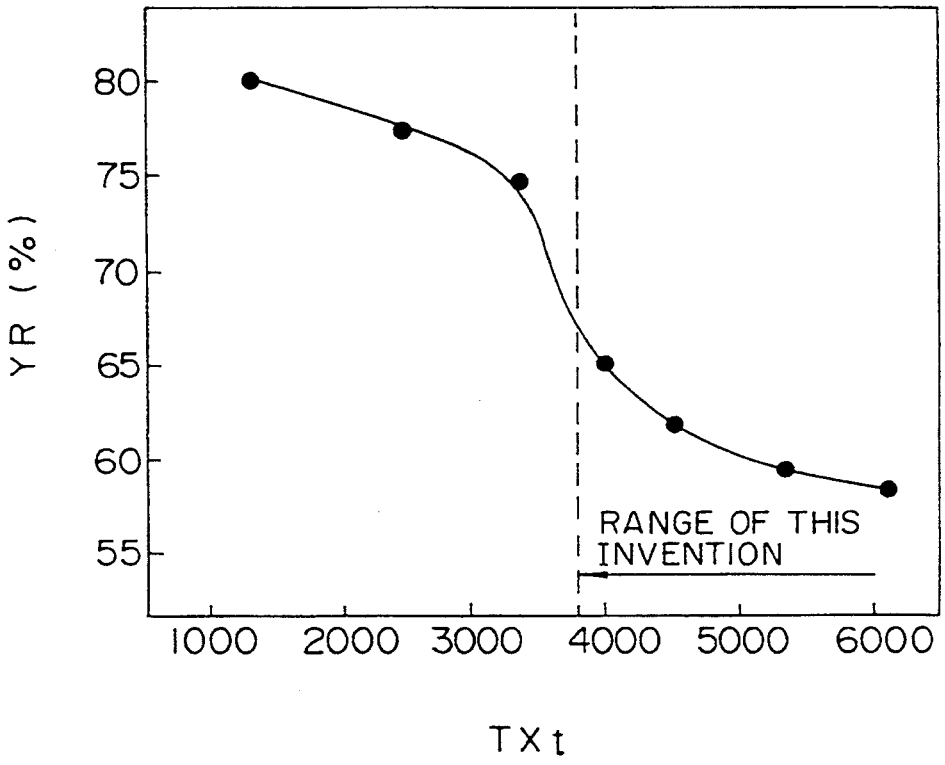
FIG. 8 is a graph showing the influence of hot-rolled sheet annealing conditions on the YR (yield-strength ratio) of a cold-rolled steel sheet.

A slab having a composition including 0.002% of C, 1.0% of Si, 1.5% of Mn, 0.03% of P, 0.005% of S, 0.05% of Al, 0.002% of N, 0.03% of Nb, and 0.0020% of B was subjected to heating/soaking at a temperature of 1150° C., and then to lubrication rolling at a finish hot-rolling temperature of 700° C. Subsequently, the hot-rolled sheet was subjected to recrystallization annealing at an annealing temperature of 600° to 800° C. for an annealing time of 0.5 to 20 hours. After that, it was cold-rolled with a reduction of 75%, and then subjected to recrystallization annealing at 850° C. for 20 seconds. FIG. 8 shows the influence of the hot-rolled-sheet annealing conditions on the YR (yield-strength ratio) after the cold-rolling/annealing which is expressed as: $(YS/TS \times 100)$. As is apparent from FIG. 8, the YR after the cold-rolling/annealing depends upon the heat-rolled-sheet annealing conditions; it has been found that by setting the annealing temperature T(°C.) and the annealing time t(hr) in such a way as to satisfy the formula: $T \times t \geqq 3800$, it is possible to obtain a low yield-strength ratio.

Figure 9:
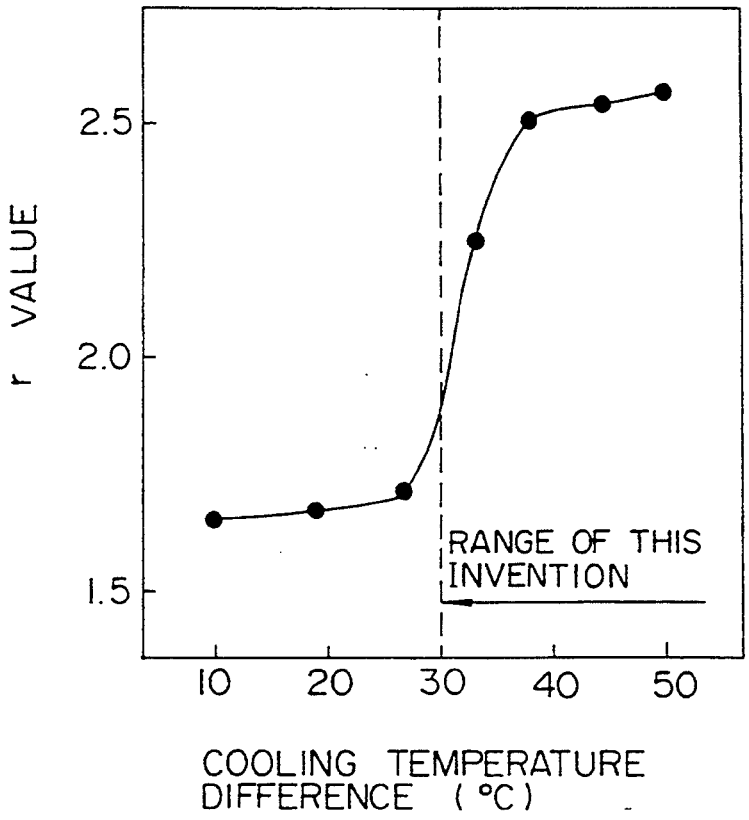
FIG. 9 is a graph showing the influence of cooling temperature difference on the r-value of a cold-rolled steel sheet.

A slab having a composition including 0.002% of C, 1.01% of Si, 1.05% of Mn, 0.051% of P, 0.005% of S, 0.05% of Al, 0.002% of N, 0.025% of Nb, and 0.003% of B was subjected to heating/soaking at a temperature of 1150° C., and then to lubrication hot rolling in such a way that the hot-rolling start temperature and the hot-rolling finish temperature were fixed at 920° C. and 700° C., respectively. In this process, the inter-pass cooling conditions were varied in such a way as to fix the cooling rate in the temperature range around the $Ar_3$ transformation temperature (which is approximately 870° C.) at 50° C./sec, varying only the cooling temperature. Subsequently, the hot-rolled sheet was subjected to recrystallization annealing at 750° C. for 5 hours. After that, it was cold-rolled with a reduction of 75%, and then subjected to recrystallization annealing at 850° C. for 20 seconds. FIG. 9 shows the influence of the cooling temperature around the $Ar_3$ transformation temperature on the r-value after the final annealing. The r-value after the annealing strongly depends upon the cooling temperature around the $Ar_3$ transformation temperature. By setting the cooling temperature around the $Ar_3$ transformation temperature at 30° C. or more, a high r-value was obtained.

Figure 10:
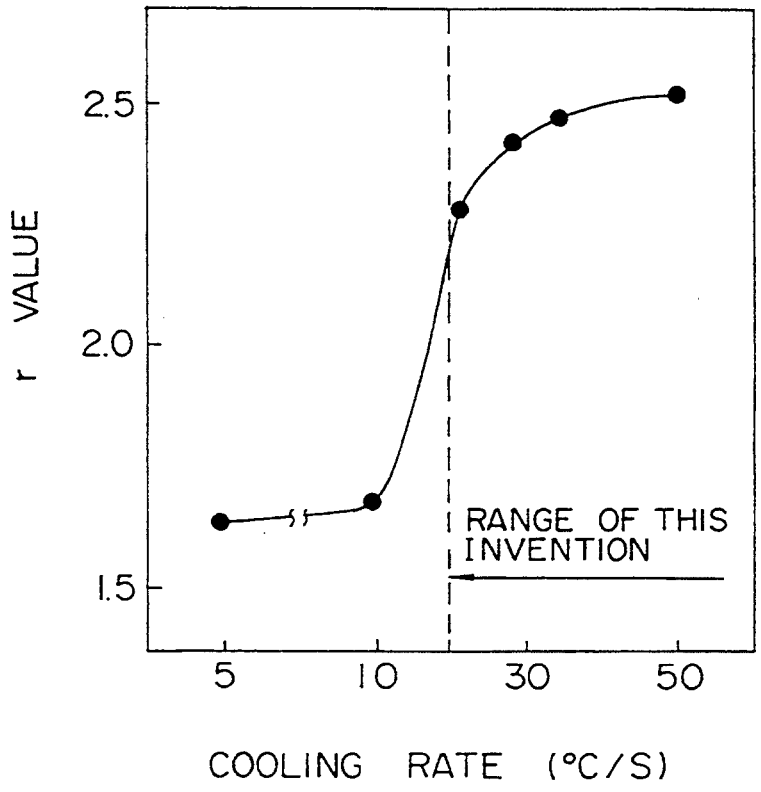
FIG. 10 is a graph showing the influence of cooling rate on the r-value of a cold-rolled steel sheet.

A slab having a composition including 0.002% of C, 1.03% of Si, 1.09% of Mn, 0.05% of P, 0.007% of S, 0.05% of Al, 0.002% of N, 0.025% of Nb, and 0.002% of B was subjected to heating/soaking at a temperature of 1150° C., and then to lubrication hot rolling in such a way that the hot-rolling start temperature and the hot-rolling finish temperature were fixed at 930° C. and 700° C., respectively. In this process, the inter-pass cooling conditions were varied in such a way as to fix the cooling temperature in the temperature range around the $Ar_3$ transformation temperature (which is approximately 870° C.) at 50° C., varying only the cooling rate. Subsequently, the hot-rolled sheet was subjected to recrystallization annealing at 750° C. for 5 hours. After that, it was cold-rolled with a reduction of 75%, and then subjected to recrystallization annealing at 850° C. for 20 seconds. FIG. 10 shows the influence of the cooling rate in the temperature range around the $Ar_3$ transformation temperature on the r-value after the final annealing. The r-value after the annealing strongly depends upon the cooling rate in the temperature range around the $Ar_3$ transformation temperature. By setting the cooling rate in the temperature range around the $Ar_3$ transformation temperature at 20° C./sec or more, a high r-value was obtained.

Figure 11:
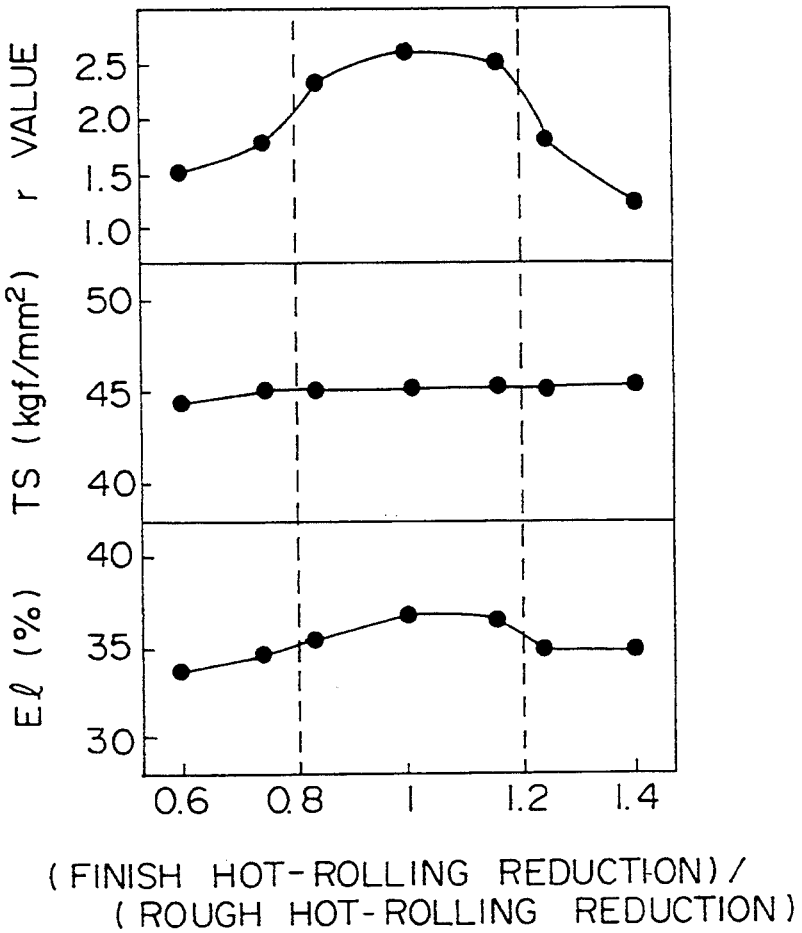
FIG. 11 is a graph showing the influence of the reduction distribution in rough and finish hot rolling processes on the r-value, TS (tensile strength) and El (elongation) of a cold-rolled steel sheet.

Further, a slab having a composition including 0.002% of C, 0.9% of Si, 1.1% of Mn, 0.05% of P, 0.005% of S, 0.05% of Al, 0.002% of N, 0.032% of Nb, and 0.0010% of B was subjected to heating/soaking at a temperature of 1150° C., and then to lubrication rolling at a hot-rolling finish temperature of 700° C. after rough hot rolling at the $Ar_3$ transformation temperature or more. Subsequently, the hot-rolled sheet was subjected to recrystallization annealing at 750° C. for 5 hours, and then to hot rolling with a reduction of 75% to obtain a sheet thickness of 0.7 mm. After that, it was subjected to recrystallization annealing at 850° C. for 20 seconds. FIG. 11 shows the influence of the rough and finish hot rolling distribution on the r-value, TS and El after the cold-rolling/annealing. The r-value and El after the cold-rolling/annealing depend upon (finish hot rolling reduction)/(rough hot rolling reduction); it has been found that by setting the (finish hot rolling reduction)/(rough hot rolling reduction) at 0.8 to 1.2, it is possible to obtain a high r-value and a high level of El.

After repeated investigations based on the above experimental results, the inventors in this case have defined the scope of the this invention as follows:

(1) Steel composition

As stated above, the steel composition is the most important of conditions for this invention; an excellent deep drawability and a high level of strength cannot be ensured unless the composition range as mentioned above is satisfied.

The reason for defining the content range of each component is now explained in detail:

(a) 0.01 wt % or less of C

The less the C-content, the better the deep drawability. However, a C-content of 0.01 wt % or less does not have much negative influence. Hence the above content range. A more preferable C-content is 0.008 wt % or less. A C-content of less than 0.001 wt % would remarkably improve the ductility of the steel obtained.

(b) 0.1 to 2.0 wt % of Si

Si, which enhances the strength of a steel, is contained in the steel in accordance with the desired level of strength. An Si-content of more than 2.0 wt % will negatively affect the deep drawability and surface configuration of the steel, so it is restricted to the range of 2.0 wt % or less. On the other hand, to realize the strength enhancing effect, an Si-content of 0.1 wt % or more is required.

(c) 0.5 to 3.0 wt % of Mn

Mn, which enhances the strength of a steel, is contained in the steel in accordance with the desired level of strength. An Mn-content of more than 3.0 wt % will negatively affect the deep drawability and surface configuration of the steel, so it is restricted to the range of 3.0 wt % or less. On the other hand, to realize the strength enhancing effect, an Mn-content of 0.5 wt % or more is required.

(d) 0.001 to 0.2 wt % of Nb

Nb is an important element in the present invention. It helps to reduce the solute C-amount in a steel through precipitation into carbide, preferentially forming the {111} orientation, which is advantageous in terms of deep drawability. Further, by incorporating Nb to the steel, its structure prior to the finish rolling is fined, preferentially forming the {111} orientation, which is advantageous in terms of deep drawability. With an Nb-content of less than 0.001 wt %, no such effect is obtained. On the other hand, an Nb-content beyond 0.2 wt % will not only prove ineffective in enhancing the above effect but also bring about a deterioration in ductility. Hence the above content range of 0.001 to 0.2 wt %.

(e) 0.0001 to 0.008 wt % of B

B is incorporated in the steel in order to attain an improvement in terms of cold-working brittleness. A B-content of less than 0.0001 wt % will provide no such effect. On the other hand, a B-content of more than 0.008 wt % will result in a deterioration in deep drawability. Hence the above content range of 0.0001 to 0.008 wt %.

(f) 0.03 to 0.20 wt % of Al

Al is an important element in this invention. It helps to reduce the amount of solute N in the steel through precipitation to preferentially form the {111} orientation, which is advantageous in improving the deep drawability of the steel. An Al-content of less than 0.03 wt % will provide no such effect. On the other hand, an Al-content of more than 0.2 wt % will not only prove ineffective in enhancing the above effect but result in a deterioration in ductility. Hence the above content range of 0.03 to 0.2 wt %.

(g) 0.02 to 0.20 wt % of P

P, which enhances the strength of a steel, is contained therein in accordance with the desired level of strength. However, with a P-content of less than 0.02%, such strengthening effect is not obtained. On the other hand, a P-content of more than 0.20 wt % will not only prove ineffective in enhancing the above effect but result in a deterioration in deep drawability. Hence the content range of 0.02 to 0.20 wt %. (h) 0.05 wt % or less of S.

The less the S-content, the better becomes the deep drawability of the steel. However, an S-content of less than 0.05 wt % does not have much negative effect. Hence the S-content of 0.05 wt % or less.

(i) 0.01 wt % or less of N

The less the N-content, the better becomes the deep drawability of the steel. However, an N-content of less than 0.01 wt % does not have much negative effect. Hence the N-content of 0.01 wt % or less.

(j) C and Nb

In this invention, it is important for the C and Nb to be contained in such a way as to satisfy the following formula: $5 \leqq Nb/C \leqq 30$. As stated above, Nb helps to reduce the amount of dissolved C in the steel through precipitation into carbide, preferentially forming the {111} orientation crystal grains, which is advantageous in attaining an improvement in deep drawability. If Nb/C is less than 5, a large amount of dissolved C is allowed to remain in the steel, so that the above effect cannot be obtained. If, on the other hand, Nb/C is more than 30, a large amount of dissolved Nb will exist in the steel, resulting in the formation of an Nb phosphide during hot-rolled sheet annealing. As a result, no {111} recrystallization structure is not formed in the hot-rolled sheet, so that an improvement in r-value cannot be expected even by the subsequent cold-rolling/annealing process. Hence the formula: $5 \leqq Nb/C \leqq 30$.

(k) Al and N

In this invention, it is important for the Al and N to be contained in such a way as to satisfy the following formula: $10 \leqq Al/N \leqq 80$. As stated above, Al helps to reduce the amount of dissolved N in the steel through precipitation into phosphide, preferentially forming the {111} orientation crystal grains, which is advantageous in attaining an improvement in deep drawability. If Al/N is less than 10, a large amount of dissolved N is allowed to remain in the steel, so that the above effect cannot be obtained. If, on the other hand, Al/N is more than 80, a large amount of dissolved N will exist in the steel, resulting in a deterioration in ductility. Hence the formula: $10 \leqq Al/N \leqq 80$.

(1) Si, Mn and P

It is important in this invention for the Si, Mn and P to be contained in the steel in such a way as to satisfy the following formula: $16 \leqq (3 \times Si/28 + 200 \times P/31)/(Mn/55) \leqq 40$. As stated above, Si, Mn and P help to enhance the strength of a steel. However, Si and P are ferrite stabilization elements, whereas Mn is an austenite stabilization element, so that it is necessary to adjust the transformation temperature by incorporating the two types of elements in a well-balanced manner. If $(3 \times Si/28 + 200 \times P/31)/(Mn/55)$ is less than 16, the transformation temperature becomes too low. If, on the other hand, $(3 \times Si/28 + 200 \times P/31)/(Mn/55)$ is more than 40, the transformation temperature will be excessively raised, resulting in the hot-rolled sheet being fined in the austenite area, which makes it difficult to accumulate machining strain in the austenite area. Hence the formula: $16 \leqq (3 \times Si/28 + 200 \times P/31)/(Mn/55) \leqq 40$.

(m) 0.01 to 1.5 wt % of Mo

Mo enhances the strength of a steel and is contained therein in accordance with the desired level of strength. An Mo-content of less than 0.01 wt % will provide no such effect. On the other hand, an Mo-content of more than 1.5 wt % will negatively affect the deep drawability of the steel. Hence the content range of 0.01 to 1.5 wt %.

(n) 0.1 to 1.5 wt % of Cu

Cu enhances the strength of a steel and is contained therein in accordance with the desired level of strength. A Cu-content of less than 0.1 wt % will provide no such effect. On the other hand, a Cu-content of more than 1.5 wt % will negatively affect the deep drawability of the steel. Hence the content range of 0.1 to 1.5 wt %.

(o) 0.1 to 1.5 wt % of Ni

Ni, which enhances the strength of a steel and improves the surface properties of the steel when it contains Cu, is contained in the steel in accordance with the desired level of strength. An Ni-content of less than 0.1 wt % will provide no such effect. On the other hand, an Ni-content of more than 1.5 wt % will negatively affect the deep drawability of the steel. Hence the content range of 0.1 to 1.5 wt %.

(p) Si, Mn, P and Ni

Further, it is desirable for the above basic-composition steel to contain 1.0 to 2.0 wt % of Si, 1.5 to 30.0 wt % of Mn, 0.05 to 0.2 wt % of P, and 0.1 to 1.5 wt % of Ni, and to satisfy the following the formulae:

$$2 \times Si + Mn + 20 \times P + Ni \geqq 6$$

and $$2.0 \leqq (2 \times Si/28 + P/31)/(Mn/55 + 0.5 \times Ni/59) \leqq 3.5.$$

As stated above, Si, Mn, P and Ni enhance the strength of a steel as dissolved reinforcement elements. To obtain such a high level of strength as can be expressed as: $TS \geqq 50$ kgf/mm$^2$, it is necessary for Si, Mn, P and Ni to be contained in such a way as to satisfy the formula: $2 \times Si + Mn + 20 \times P + Ni \geqq 6$. However, Si and P are ferrite stabilization elements, whereas Mn is an austenite stabilization element, so that it is necessary to adjust the transformation temperature through incorporation of the two types of elements in a well-balanced manner. If $(2 \times Si/28 + P/31)/(Mn/55 + 0.5 \times Ni/59)$ is less than 2.0, the transformation temperature will become too low. If, on the other hand, $(2 \times Si/28 + P/31)/(Mn/55 + 0.5 \times Ni/59)$ is more than 3.5, the transformation temperature will be excessively raised, resulting in the hot-rolled sheet being fined in the austenite area, which would make it difficult for machining strain to be accumulated in the ferrite area. Hence the formula: $2.0 \leqq (2 \times Si/28 + P/31)/(Mn/55 + 0.5 \times Ni/59) \leqq 3.5$.

(q) Ti, N, S and P

Further, it is desirable for the above basic-composition steel to contain 0.005 to 0.06 wt % of Ti and to satisfy the formula: $48 \times (Ti/48 + N/14 - S/32) \times P \leqq 0.0015$. Ti is an element forming phosphates. If there is a large amount of dissolved Ti, a Ti-phosphide will precipitate in great quantities during hot-rolled sheet annealing, so that no {111} orientation structure is formed in the hot-rolled sheet. Thus, an improvement in r-value cannot be expected even by the subsequent cold-rolling/annealing. If $48 \times (Ti/48 - N/14 - S/32) \times P$ is larger than 0.0015, a large amount of Ti-phosphide will precipitate, resulting in a deterioration in r-value. Hence the formula: $48 \times (Ti/48 - N/14 - S/32) \times P \leqq 0.0015$.

Next, the reason for specifying the production processes in this invention will be explained in detail.

(2) Hot-rolling process

The hot-rolling process is important in this invention. It is necessary to perform rolling with a total reduction of not less than 50% and not more than 95% while effecting lubrication in the temperature range of not more than the $Ar_3$ transformation temperature and not less than 500° C.

In a temperature range beyond the $Ar_3$ transformation temperature, the texture becomes irregular, no matter how much the rolling is performed, due to the $\gamma$-$\alpha$ transformation therein, so that no {111} texture is formed in the hot-rolled sheet, resulting in only a low r-value being obtained after cold-rolling/annealing. If, on the other hand, the rolling temperature is lower than 500° C., no improvement in r-value is to be expected, with only the rolling load increasing. Thus, the rolling temperature is restricted to the range of not more than the $Ar_3$ transformation temperature and not less than 500° C.

If the reduction in this rolling is less than 50%, no {111} texture is formed in the hot-rolled sheet. If, on the other hand, the reduction is more than 95%, a texture is formed in the hot-rolled sheet which is not desirable in tenths of r-value. Hence, the restriction of the reduction to the range of not less than 50% and not more than 95%.

Further, if hot rolling is performed below the $Ar_3$ transformation temperature with no lubrication being effected, {110} orientation crystal grains, which are undesirable in improving the deep drawability of the steel, are preferentially formed in the surface portion of the steel sheet as a result of shear deformation due to the frictional force between the roll and the steel sheet, so that an improvement in r-value cannot be expected.

Therefore, it is necessary to perform lubrication rolling to ensure the requisite deep drawability.

The diameter and structure of the roll, the type of lubricant, and the type of rolling mill may be arbitrarily selected.

Further, there are no particular restrictions as to the processes prior to the above rolling. For example, the rolled material may be in the form of a sheet bar obtained directly by rough rolling after re-heating or continuous casting of a continuous slab, without lowering the temperature below the $Ar_3$ transformation temperature, or from one which has undergone heat-retaining treatment. It is also possible to perform the above rolling subsequent to rough hot rolling at a finish temperature which is not lower than the $Ar_3$ transformation temperature. In order to fine the texture prior to the finish rolling, it is desirable for the rough-rolling finish temperature to be in the range: ($Ar_3$ transformation temperature−50° C.)~($Ar_3$ transformation temperature+50° C.).

Further, the hot-rolling process may be conducted as follows:

That is, the finish rolling is started at a temperature not lower than the $Ar_3$ transformation temperature, and cooling is performed at a cooling rate of 20° C./s and with a cooling temperature difference of 30° C. or more with the $Ar_3$ transformation temperature therebetween, without conducting any other rolling during that rolling process. After that, rolling is performed with a total reduction of not less than 50% and not more than 95% while effecting lubrication in the temperature range of not higher than the $Ar_3$ transformation temperature and not lower than 500° C.

The finish-rolling start temperature is not lower than the $Ar_3$ transformation temperature. If it is lower than this temperature, it is impossible to fine the $\gamma$ particles in finish rolling, with the result that no {111} texture is formed in the hot-rolled sheet and only a low r-value can be obtained. After starting finish rolling at a temperature not lower than the $Ar_3$ transformation temperature, it is necessary to effect cooling to a temperature not higher than the $Ar_3$ transformation temperature at a cooling rate of not less than 20° C./s and at a cooling temperature of not less than 30° C., without performing any other rolling process during that rolling. If this cooling does not occur, the $\gamma$ particles, which have been fined by the rolling at a temperature not lower than the $Ar_3$ transformation temperature, will be allowed to grow larger again, resulting in no {111} texture being formed in the hot-rolled sheet. Thus, only a low r-value could be obtained, as apparent from the above experiment results. The above cooling at a temperature around the $Ar_3$ transformation temperature can be effected between intermediate stands or between the first and third stands of the finish rolling mill group.

If the rolling after the cooling at a temperature around $Ar_3$ transformation temperature is performed in a temperature range not less than $Ar_3$ transformation temperature, the texture becomes irregular because of the $\gamma$-$\alpha$ transformation, no matter how much rolling is performed, with the result that no {111} texture is foraged in the hot-rolled steel sheet and only a low r-value can be obtained. If, on the other hand, the rolling temperature is lowered to a level not higher than 500° C., a further improvement in r-value cannot be expected, only the rolling load being increased. Therefore, the rolling after the cooling should be performed at a temperature not higher than the $Ar_3$ transformation temperature and not lower than 500° C.

It is desirable that the finish hot rolling subsequent to the rough hot rolling be performed under the following conditions: the ratio of the finish hot-rolling reduction to the rough hot-rolling reduction: 0.8 to 1.2; the terminating temperature of the rough hot rolling: not lower than ($Ar_3$ transformation temperature−50° C.) and not higher than ($Ar_3$ transformation temperature+50° C.); the finish hot-rolling temperature range: not higher than the $Ar_3$ transformation temperature and not lower than 500° C., while effecting lubrication with a total reduction of not less than 50% and not more than 95%.

That is, if (finish hot rolling reduction)/(rough hot rolling reduction) is less than 0.8, no {111} texture is formed in the hot-rolled sheet due to the low finish hot rolling reduction, so that only a low r-value can be obtained after cold-rolling/annealing. If, on the other hand, (finish hot rolling reduction)/(rough hot rolling reduction) is larger than 1.2, the texture prior to the finish hot rolling is not fined due to the low rough hot rolling reduction, so that no {111} texture is formed in the hot-rolled sheet even if finish hot rolling is performed at a temperature not higher than the $Ar_3$ transformation temperature; thus only a low r-value could be obtained after cold-rolling/annealing. Therefore, (finish hot rolling reduction)/(rough hot rolling reduction) is restricted to the range of 0.8 to 1.2.

If the rough hot rolling is terminated in a temperature range higher than ($Ar_3$ transformation temperature+100° C.), the texture prior to the finish hot rolling will grow coarser, so that no {111} texture is formed in the hot-rolled sheet even if finish hot rolling is performed afterwards at a temperature not higher than the $Ar_3$ transformation temperature; thus only a low r-value could be obtained after cold-rolling/annealing. If, on the other hand the rough hot rolling is terminated in a temperature range lower than ($Ar_3$ transformation temperature−50° C.), no {111} texture is formed in the hot-rolled sheet even if the finish hot rolling is performed afterwards at a temperature not higher than the $Ar_3$ transformation temperature since the texture prior to the finish hot rolling includes a processed texture; thus, only a low r-value could be obtained after cold-rolling/annealing. Therefore, the rough hot rolling terminating temperature is restricted to the range: ($Ar_3$ transformation temperature−50° C.)~($Ar_3$ transformation temperature+50° C.). Further, if the finish hot rolling is performed in a temperature range not lower than the $Ar_3$ transformation temperature, the texture grows irregular because of the $\gamma$-$\alpha$transformation, no matter how much rolling is performed, with the result that no {111} texture is formed in the hot-rolled sheet; only a low r-value can be obtained after cold-rolling/annealing. If, on the other hand, the rolling temperature is lowered to below 500° C., a further improvement in r-value cannot be expected, and only the rolling load being increased. Thus, it is desirable for the finish hot rolling temperature to be not higher than the $Ar_3$ transformation temperature and not lower than 500° C.

(3) Hot-rolled sheet recrystallization process

With the steel of this invention, the hot-rolling temperature is not higher than the $Ar_3$ transformation temperature, so that the hot-rolled sheet exhibits a processed texture. Therefore, it is necessary to form{ill-}orientation crystal grains by performing recrystallization on the hot-rolled sheet. If no recrystallization is performed, no {111} orientation crystal grains are formed in the hot-rolled sheet, so that an improvement in r-value cannot be attained even by the subsequent cold-rolling/annealing process.

This hot-rolled sheet recrystallization process is effected through the coiling or the recrystallization annealing during hot rolling. When effecting recrystallization through the coiling process, it is desirable for the coiling temperature to be not lower than 650° C. If the coiling temperature is lower than 650° C., the hot-rolled sheet is hard to re-crystallize, so that no {111} orientation crystal grains are formed in the hot-rolled sheet; thus, an improvement in r-value cannot be expected even by the subsequent cold-rolling/annealing process. When effecting recrystallization by the recrystallization/annealing process, both batch annealing and continuous annealing are applicable. The annealing temperature is preferably in the range of 650° to 950° C.

In the case of continuous annealing, the recrystallization of the hot-rolled sheet be performed at a heating rate of not lower than 1° C./s, and at an annealing temperature of 700° to 950° C. That is, in a high-P-content steel containing 0.06 wt % or more of P, the heating rate in the hot-rolled sheet annealing is important, which is desirable to be not lower than 1° C./s. If the hot-rolled sheet heating rate is lower than 1° C., a large amount of phosphate is formed during recrystallization, with the result that no {111} recrystallization texture is formed in the hot-rolled sheet. Accordingly, an improvement in r-value is not to be expected even by the subsequent cold-rolling/annealing process. In contrast, if the heating rate for the hot-rolled sheet annealing is 1° C./s or more, no phosphate is formed during recrystallization annealing, and {111} recrystallization texture is formed in the hot-rolled sheet, so that an improvement in r-value is attained through the subsequent cold-rolling/annealing process.

In the case of batch annealing, it is desirable that the hot-rolled sheet recrystallization be conducted at an annealing temperature T of not lower than 600° C. and not higher than 900° C., and at an annealing time t which satisfies the following condition: $T \times t \geqq 3800$. When the annealing temperature T is lower than 600° C., a low yield strength cannot be obtained. If, on the other hand, the annealing temperature is higher than 900° C., an abnormal grain growth occurs in the hot-rolled sheet, so that a high r-value cannot be obtained. When $T \times t$ is less than 3800, a low yield strength cannot be obtained.

It is to be assumed that the above influence of the hot-rolled sheet annealing conditions on the yield strength is attributable to the fact that the crystal diameter of the hot-rolled sheet and the precipitate in the hot-rolled sheet become larger by performing hot-rolled sheet annealing for a long time at high temperature, which leads to an increase in the crystal grain size after the cold-rolling/recrystallization annealing, resulting in an reduction in yield strength.

Apart from the ordinary batch annealing, the hot-rolled sheet annealing can be performed by performing temperature retention or some heating on a hot-coiled hot-rolled sheet.

(4) Cold-rolling process

This process is indispensable to obtaining a high r-value. It is essential for the cold-rolling reduction to be 50 to 95%. If the cold-rolling reduction is less than 50% or more than 95%, an excellent deep drawability cannot be obtained.

(5) Annealing process

It is necessary for the cold-rolled steel sheet to be subjected to recrystallization annealing. This recrystallization annealing may be effected either by box annealing or continuous annealing. If the annealing temperature is less than 700° C., the recrystallization does not take place to a sufficient degree, so that no {111} texture is developed. If, on the other hand, the annealing temperature is higher than 950° C., the texture becomes irregular as a result of $\gamma$-$\alpha$ transformation, so that the annealing temperature is restricted to the range of 700° to 950° C.

It goes without saying that a refining rolling of 10% or less may be performed on the steel sheet after the annealing for the purpose of configurational rectification, surface roughness adjustment, etc. Further, a cold-rolled steel sheet obtained by the method of this invention can be used as a master sheet for surface-treated steel sheet for processing. Examples of the surface treatment include galvanization (including an alloy-type one), tinning, or enamelling.

To perform press working on a high-strength cold-rolled steel sheet having a strength of 35 kgf/mm$^2$ or more, it is necessary for the product of the tensile strength and the r-value ($TS \times r$) to be 105 or more. Unless a steel sheet satisfying this is obtained in a stable manner, a satisfactory press working of a high-strength cold-rolled steel sheet cannot be realized.

In accordance with this invention, the steel composition and the crystal orientation are specified so as to enable a high-strength cold-rolled steel sheet which has a tensile strength of 35 kgf/mm$^2$ or more and in which $TS \times r$ is 105 or

Embodiments

Rough hot rolling, finish hot rolling and recrystallization treatment were performed on steel slabs A through K having the compositions shown in Table 1, under the hot-rolling conditions shown in Table 2. After pickling the hot-rolled sheets obtained, cold rolling was performed under the conditions shown in Table 2 to obtain cold-rolled steel sheets in coil having a sheet thickness of 0.7 mm. After that, recrystallization treatment was performed with a continuous annealing equipment at 890° C. for 20 seconds. Table 2 shows the results of a examination of the material properties of the cold-rolled steel sheets obtained.

The tensile strength was measured by using JIS No. 5 tensile-strength-test piece. The r-value was measured by the three-point method after imparting a tensile prestrain of 15% to the specimens, obtaining an average value of the L-direction (rolling direction), the D-direction (45° to the rolling direction) and the C-direction (90° to the rolling direction) as:

$$r=(r_L+2r_D+r_C)/4$$

The stars at the right-hand end of the tables indicate comparative examples.

It will be appreciated from the table that the cold-rolled steel sheets produced within the range of the present invention exhibit a higher r-value and a higher level of ductility than the comparative examples, thus providing an excellent deep drawability with which $TS \times r$ is 105 or more.

Rough hot rolling, finish hot rolling and recrystallization treatment were performed on steel slabs L through T having the compositions shown in Table 1, under the hot-rolling conditions shown in Table 3. After pickling the hot-rolled sheets obtained, cold rolling was performed under the conditions shown in Table 3 to obtain cold-rolled steel sheets in coil having a sheet thickness of 0.7 mm. After that, recrystallization treatment was performed with a continuous annealing equipment at 890° C. for 20 seconds. Table 3 shows the results of a examination of the material properties of the cold-rolled steel sheets obtained.

It will be appreciated from the table that the cold-rolled steel sheets produced within the range of the present invention exhibit a higher r-value and a higher level of ductility than the comparative examples, thus providing an excellent deep drawability and a high level of strength with which TS×r is 120 or more.

Rough hot rolling, finish hot rolling and recrystallization treatment were performed on the steel slab O having the composition shown in Table 1, under the hot-rolling conditions shown in Table 4. After pickling the hot-rolled sheet obtained, cold rolling was performed under the conditions shown in Table 4 to obtain cold-rolled steel sheet in coil having a sheet thickness of 0.7 mm. After that, recrystallization treatment was performed with a continuous annealing equipment at 890° C. for 20 seconds. Table 4 shows the results of an examination of the material properties of the cold-rolled steel sheet obtained.

It will be appreciated from the table that the cold-rolled steel sheet produced within the range of the present invention exhibit a higher r-value and a higher level of ductility than the comparative examples, thus providing an excellent deep drawability and a high level of strength with which TS×r is 120 or more.

Rough hot rolling, finish hot rolling and recrystallization treatment were performed on the steel slab B having the composition shown in Table 1, under the hot-rolling conditions shown in Table 5. After pickling the hot-rolled sheet obtained, cold rolling was performed under the conditions shown in Table 5 to obtain cold-rolled steel sheet in coil having a sheet thickness of 0.7 mm. After that, recrystallization treatment was performed with a continuous annealing equipment at 890° C. for 20 seconds. Table 5 shows the results of an examination of the material properties of the cold-rolled steel sheet obtained.

It will be appreciated from the table that the cold-rolled steel sheet produced within the range of the present invention exhibit a higher r-value and a higher level of ductility than the comparative examples, thus providing an excellent deep drawability and a high level of strength with which TS×r is 120 or more.

After performing finish rolling on the steel slab B having the composition shown in Table 1 with a 7-stand hot-rolling mill under the hot-rolling conditions shown in Table 6, recrystallization treatment was conducted. Regarding specimen No. 34, cooling was performed in the temperature range around the $Ar_3$ transformation temperature by empty-pass rolling in F3 stand. Subsequently, cold rolling and continuous rolling were performed under the conditions shown in Table 6. Table 6 shows the results of an examination of the material properties of the cold-rolled steel sheet obtained.

It will be appreciated from the table that the cold-rolled steel sheet produced within the range of the present invention exhibits a higher r-value and a higher level of ductility than the comparative examples, thus providing an excellent deep drawability and a high level of strength with which TS×r is 120 or more.

Rough hot rolling, finish hot rolling and recrystallization treatment were performed on the steel slab B having the composition shown in Table 1, under the hot-rolling conditions shown in Table 7. After pickling the hot-rolled sheet obtained, cold rolling was performed under the conditions shown in Table 7 to obtain cold-rolled steel sheet in coil having a sheet thickness of 0.7 mm. After that, recrystallization treatment was performed with a continuous annealing equipment at 890° C. for 20 seconds. Table 7 shows the results of an examination of the material properties of the cold-rolled steel sheet obtained.

It will be appreciated from the table that the cold-rolled steel sheet produced within the range of the present invention exhibit a higher r-value and a higher level of ductility than the comparative examples, thus providing an excellent deep drawability and a high level of strength with which TS×r is 120 or more.

In accordance with the present invention, the steel component and the production conditions are specified so as to enable a thin steel sheet to be produced which has a deep drawability and a strength which are by far superior to those of the conventional steel sheets.

TABLE 1

| STEEL | C | Si | Mn | P | S | Al | N | Nb | Ti | B | Cu |
|---|---|---|---|---|---|---|---|---|---|---|---|
| A | 0.0021 | 0.53 | 0.56 | 0.051 | 0.007 | 0.044 | 0.002 | 0.025 | — | 0.0008 | — |
| B | 0.0023 | 1.05 | 1.08 | 0.048 | 0.005 | 0.058 | 0.002 | 0.031 | — | 0.0011 | — |
| C | 0.0025 | 0.96 | 1.42 | 0.055 | 0.004 | 0.045 | 0.001 | 0.038 | — | 0.0018 | — |
| D | 0.0020 | 0.22 | 1.71 | 0.045 | 0.008 | 0.044 | 0.002 | 0.031 | — | 0.0011 | — |
| E | 0.0033 | 1.02 | 1.65 | 0.068 | 0.006 | 0.062 | 0.001 | 0.052 | — | 0.0018 | — |
| F | 0.0026 | 0.15 | 1.68 | 0.129 | 0.006 | 0.050 | 0.002 | 0.039 | — | 0.0019 | — |
| G | 0.0021 | 1.22 | 0.94 | 0.081 | 0.008 | 0.018 | 0.002 | 0.003 | — | — | — |
| H | 0.025 | 0.05 | 0.25 | 0.091 | 0.012 | 0.036 | 0.002 | 0.102 | — | 0.0010 | — |
| I | 0.0020 | 0.23 | 0.71 | 0.055 | 0.005 | 0.045 | 0.001 | 0.033 | — | 0.0010 | 0.5 |
| J | 0.0009 | 1.01 | 1.02 | 0.048 | 0.001 | 0.052 | 0.001 | 0.025 | — | 0.0030 | — |
| K | 0.0022 | 1.02 | 1.03 | 0.052 | 0.005 | 0.062 | 0.002 | 0.006 | 0.062 | — | — |
| L | 0.0022 | 1.52 | 2.01 | 0.120 | 0.005 | 0.043 | 0.002 | 0.028 | — | 0.0028 | — |
| M | 0.0028 | 1.48 | 1.58 | 0.105 | 0.007 | 0.049 | 0.002 | 0.035 | — | 0.0018 | 0.5 |
| N | 0.0025 | 1.51 | 2.01 | 0.11 | 0.005 | 0.06 | 0.002 | 0.035 | — | 0.0030 | — |
| O | 0.0018 | 1.53 | 1.98 | 0.08 | 0.005 | 0.05 | 0.002 | 0.028 | 0.025 | 0.0055 | — |
| P | 0.0035 | 1.11 | 1.98 | 0.10 | 0.007 | 0.05 | 0.001 | 0.031 | — | 0.0031 | — |
| Q | 0.0024 | 1.50 | 3.99 | 0.09 | 0.006 | 0.07 | 0.001 | 0.027 | — | 0.0027 | — |
| R | 0.0022 | 1.75 | 1.26 | 0.06 | 0.007 | 0.05 | 0.002 | 0.031 | — | 0.0036 | — |
| S | 0.0021 | 1.49 | 2.01 | 0.10 | 0.006 | 0.07 | 0.002 | 0.030 | — | 0.0032 | 0.5 |
| T | 0.0022 | 1.70 | 2.51 | 0.12 | 0.005 | 0.05 | 0.002 | 0.030 | — | 0.0030 | — |

| STEEL | Ni | Mo | [Nb]/[C] | [Al]/[N] | X | Y | Z | W | $Ar_3$ |
|---|---|---|---|---|---|---|---|---|---|

TABLE 1-continued

| | | | | | | | | | |
|---|---|---|---|---|---|---|---|---|---|
| A | — | — | 11.9 | 22.0 | 37.9 | 2.64 | 3.88 | — | 910 |
| B | — | — | 13.5 | 29.0 | 21.5 | 4.14 | 3.90 | — | 870 |
| C | — | — | 15.2 | 45.0 | 17.7 | 4.44 | 2.72 | — | 850 |
| D | — | 0.65 | 15.5 | 22.0 | 10.1 | 3.05 | 0.55 | — | 860 |
| E | — | — | 15.8 | 62.0 | 18.3 | 5.05 | 2.50 | — | 860 |
| F | — | 0.25 | 15.0 | 25.0 | 27.8 | 4.56 | 0.49 | — | 910 |
| G | — | — | 1.4 | 9.0 | 38.2 | 5.00 | 5.25 | — | 930 |
| H | — | — | 4.1 | 18.0 | 130.3 | 2.17 | 1.43 | — | 890 |
| I | 0.5 | — | 16.5 | 45.0 | 29.4 | 2.27 | 1.41 | — | 890 |
| J | — | — | 27.8 | 52.0 | 22.5 | 4.0 | 4.0 | — | 870 |
| K | — | — | 2.7 | 31.0 | 23.7 | 4.1 | 4.0 | 0.0025 | 860 |
| L | — | 0.45 | 12.7 | 21.5 | 25.6 | 7.45 | 3.1 | — | 890 |
| M | 0.4 | 0.44 | 12.5 | 24.5 | 29.1 | 7.04 | 3.4 | — | 900 |
| N | 0.5 | — | 14.0 | 30.0 | 23.8 | 7.7 | 2.7 | — | 850 |
| O | 0.8 | — | 15.6 | 25.0 | 18.9 | 7.4 | 2.6 | 0.0009 | 860 |
| P | 0.5 | — | 8.9 | 50.0 | 21.2 | 6.7 | 2.1 | — | 890 |
| Q | 0.2 | — | 11.3 | 70.0 | 10.2 | 9.0 | 1.5 | — | 830 |
| R | 0.2 | — | 14.1 | 25.0 | 25.1 | 6.2 | 5.2 | — | 860 |
| S | 0.4 | — | 14.3 | 35.0 | 22.0 | 7.4 | 2.7 | — | 850 |
| T | 1.0 | — | 13.2 | 25.0 | 21.0 | 9.3 | 2.3 | — | 900 |

$X = (3 \times Si/28 + 200 \times P/31)/(Mn/55)$
$Y = 2 \times Si + Mn + 20 \times P + Ni$
$Z = (2 \times Si/28 + P/31)/(Mn/55 + 0.5 \times Ni/59)$
$W = 48(Ti/48 - N/14 - S/32) \times P$
The stars at the right-hand end indicate comparative examples.

TABLE 2

| Specimen No. | Steel | Hot-Rolling Conditions: FDT | Reduction | Coiling Temperature | Lubrication | Hot-Rolled Sheet Recrystallizing Conditions |
|---|---|---|---|---|---|---|
| 1 | A | 740° C. | 90% | 710° | Some | Coiling-Annealing |
| 2 | A | 930° C. | 90% | 680° | Some | Coiling-Annealing |
| 3 | B | 750° C. | 90% | 450° | Some | 750° C.-5 hr |
| 4 | B | 730° C. | 45% | 450° | Some | 750° C.-5 hr |
| 5 | C | 720° C. | 90% | 450° | Some | 750° C.-5 hr |
| 6 | C | 710° C. | 90% | 450° | None | 750° C.-5 hr |
| 7 | D | 720° C. | 90% | 450° | Some | 750° C.-5 hr |
| 8 | E | 760° C. | 90% | 450° | Some | 750° C.-5 hr |
| 9 | F | 740° C. | 90% | 450° | Some | 890° C.-20s |
| 10 | F | 710° C. | 90% | 450° | Some | 890° C.-20s |
| 11 | G | 730° C. | 90% | 450° | Some | 750° C.-5 hr |
| 12 | H | 730° C. | 90% | 450° | Some | 750° C.-5 hr |
| 13 | I | 710° C. | 90% | 450° | Some | 750° C.-5 hr |
| 14 | J | 710° C. | 90% | 450° | Some | 750° C.-5 hr |
| 15 | K | 680° C. | 90% | 450° | Some | 750° C.-5 hr |

| Specimen No. | Cold-Rolling Reduction | Cold-Rolled Sheet Annealing Conditions | Material Properties: TS (kgf/mm²) | El (%) | r-Value | TS × r |
|---|---|---|---|---|---|---|
| 1 | 78% | 890° C.-20s | 38 | 43 | 2.8 | 106 |
| 2 | 78% | 890° C.-20s | 37 | 40 | 1.3 | 48 |
| 3 | 78% | 890° C.-20s | 46 | 37 | 2.5 | 115 |
| 4 | 78% | 890° C.-20s | 45 | 33 | 1.4 | 63 |
| 5 | 78% | 890° C.-20s | 49 | 33 | 2.4 | 118 |
| 6 | 78% | 890° C.-20s | 49 | 26 | 1.1 | 54 |
| 7 | 78% | 890° C.-20s | 47 | 37 | 2.0 | 94 |
| 8 | 78% | 890° C.-20s | 49 | 33 | 2.4 | 118 |
| 9 | 78% | 890° C.-20s | 46 | 36 | 2.5 | 115 |
| 10 | 45% | 890° C.-20s | 45 | 33 | 1.2 | 54 |
| 11 | 78% | 890° C.-20s | 38 | 35 | 1.1 | 42 |
| 12 | 78% | 890° C.-20s | 39 | 36 | 1.0 | 39 |
| 13 | 78% | 890° C.-20s | 38 | 42 | 2.8 | 106 |
| 14 | 78% | 890° C.-20s | 45 | 40 | 2.6 | 117 |
| 15 | 78% | 890° C.-20s | 46 | 33 | 1.6 | 74 |

TABLE 3

| Specimen No. | Steel | Hot-Rolling Conditions: FDT | Reduction | Coiling Temperature | Lubrication | Hot-Rolled Sheet Recrystallizing Conditions |
|---|---|---|---|---|---|---|
| 16 | L | 650° C. | 90% | 450° | Some | 890° C.-20s |
| 17 | L | 670° C. | 90% | 450° | Some | None |

TABLE 3-continued

| | | | | | | |
|---|---|---|---|---|---|---|
| 18 | M | 710° C. | 90% | 450° | Some | 750° C.-5 hr |
| 19 | N | 690° C. | 90% | 450° | Some | 890° C.-20s |
| 20 | O | 680° C. | 90% | 450° | Some | 890° C.-20s |
| 21 | P | 710° C. | 90% | 450° | Some | 890° C.-20s |
| 22 | Q | 720° C. | 90% | 450° | Some | 890° C.-20s |
| 23 | R | 650° C. | 90% | 450° | Some | 750° C.-5 hr |
| 24 | S | 680° C. | 90% | 450° | Some | 890° C.-20s |
| 25 | T | 720° C. | 90% | 450° | Some | 750° C.-5 hr |

| Specimen No. | Cold-Rolling Reduction | Cold-Rolled Sheet Annealing Conditions | Material Properties TS (kgf/mm²) | El (%) | r-Value | TS × r |
|---|---|---|---|---|---|---|
| 16 | 78% | 890° C.-20s | 61 | 31 | 2.0 | 122 |
| 17 | 78% | 890° C.-20s | 60 | 24 | 1.1 | 66 |
| 18 | 78% | 890° C.-20s | 62 | 31 | 2.0 | 124 |
| 19 | 78% | 890° C.-20s | 60 | 30 | 2.1 | 126 |
| 20 | 78% | 890° C.-20s | 59 | 31 | 2.1 | 124 |
| 21 | 78% | 890° C.-20s | 55 | 32 | 2.2 | 121 |
| 22 | 78% | 890° C.-20s | 68 | 12 | 1.1 | 75 |
| 23 | 78% | 890° C.-20s | 59 | 30 | 1.8 | 106 |
| 24 | 78% | 890° C.-20s | 62 | 28 | 2.0 | 124 |
| 25 | 78% | 890° C.-20s | 65 | 28 | 1.9 | 124 |

TABLE 4

| Specimen No. | Steel | Hot-Rolling Conditions FDT | Reduction | Coiling Temperature | Lubrication | Hot-Rolled Sheet Annealing Conditions Heating Rate | Soaking Temperature |
|---|---|---|---|---|---|---|---|
| 26 | O | 710° C. | 85% | 450° C. | Some | 10° C./s | 890° C. |
| 27 | O | 690° C. | 85% | 450° C. | Some | 0.6° C./s | 750° C. |
| 28 | O | 700° C. | 85% | 450° C. | Some | 0.06° C./s | 750° C. |

| Specimen No. | Cold-Rolling/Annealing Conditions Reduction | Annealing Conditions | Material Properties TS (kgf/mm²) | r-Value | TS × r |
|---|---|---|---|---|---|
| 26 | 78% | 890° C.-20s | 59 | 2.1 | 124 |
| 27 | 78% | 890° C.-20s | 59 | 1.5 | 89 |
| 28 | 78% | 890° C.-20s | 60 | 1.4 | 84 |

TABLE 5

| Specimen No. | Steel | Hot-Rolling Conditions FDT (°C.) | Reduction (%) | Coiling Temperature (°C.) | Lubrication | Hot-Rolled Sheet Annealing Conditions Temperature (T) Time (t) | Txt |
|---|---|---|---|---|---|---|---|
| 29 | B | 710° C. | 90% | 450° C. | Some | 680° C., 5h | 3,400 |
| 30 | B | 720° C. | 90% | 450° C. | Some | 750° C., 15h | 11,250 |
| 31 | B | 700° C. | 90% | 450° C. | Some | 770° C., 5h | 3,850 |

| Specimen No. | Cold-Rolling Reduction (%) | Material Properties YS (kgf/mm²) | TS (kgf/mm²) | YR (%) | El (%) | r-Value | TS × r |
|---|---|---|---|---|---|---|---|
| 29 | 78 | 31 | 46 | 67 | 37 | 2.3 | 106 |
| 30 | 78 | 28 | 45 | 62 | 39 | 2.6 | 117 |
| 31 | 78 | 27 | 46 | 63 | 39 | 2.6 | 120 |

TABLE 6

| Specimen No. | Steel | Hot-Rolling Conditions FET (°C.) | Reduction above $Ar_3$ | Cooling Temperature Difference (°C.) | Cooling Rate | Cooling Stand | Reduction below $Ar_3$ | FDT (°C.) | CT (°C.) | Lubrication |
|---|---|---|---|---|---|---|---|---|---|---|
| 32 | B | 920 | 70 | 80 | 30 | F2–F3 | 80 | 710 | 450 | Some |
| 33 | B | 850 | — | — | — | — | 90 | 690 | 450 | Some |
| 34 | B | 930 | 70 | 60 | 30 | F2–F4 | 80 | 680 | 450 | Some |

| Specimen No. | Hot-Rolled Sheet Recrystallization | Cold-Rolling/Annealing Cold-Rolling Reduction | Final Annealing | Material Properties TS (kgf/mm²) | El (%) | r-Value | TS × r |
|---|---|---|---|---|---|---|---|
| 32 | 750° C., 5 hr | 78 | 890° C., 20s | 46 | 37 | 2.7 | 124 |
| 33 | 750° C., 5 hr | 78 | 890° C., 20s | 46 | 37 | 2.3 | 106 |

TABLE 6-continued

| | | | | | | | |
|---|---|---|---|---|---|---|---|
| 34 | 750° C., 5 hr | 78 | 890° C., 20s | 46 | 37 | 2.7 | 124 |

TABLE 7

| Specimen No. | Steel | Hot Rough Rolling Conditions: Finish Temperature (°C.) | Hot Rough Rolling Conditions: Reduction (%) | Hot Finish Rolling Conditions: Finish Temperature (°C.) | Hot Finish Rolling Conditions: Reduction (%) | Lubrication | Finish Reduction/ Rough Reduction | Coiling Temperature |
|---|---|---|---|---|---|---|---|---|
| 35 | B | 890 | 88 | 700 | 89 | Some | 1.01 | 450° C. |
| 36 | B | 890 | 96 | 690 | 45 | Some | 0.47 | 450° C. |
| 37 | B | 900 | 67 | 710 | 92 | Some | 1.37 | 450° C. |

| Specimen No. | Hot-Rolled Sheet Recrystallizing Conditions | Cold-Rolling Reduction | Recrystallization/ Annealing Conditions after Cold Rolling | Material Properties: TS (kgf/mm²) | Material Properties: El (%) | Material Properties: r-Value | Material Properties: TS × r |
|---|---|---|---|---|---|---|---|
| 35 | 750° C., 5 hr | 78% | 890° C., 20s | 46 | 37 | 2.6 | 120 |
| 36 | 750° C., 5 hr | 78% | 890° C., 20s | 46 | 36 | 2.3 | 106 |
| 37 | 750° C., 5 hr | 78% | 890° C., 20s | 46 | 36 | 2.3 | 106 |

What is claimed is:

1. A method of producing a high-strength cold-rolled steel sheet which excels in deep drawability by using a steel material consisting of: a basic composition including 0.01% or less of C, 0.1 to 2.0% of Si, 0.5 to 3.0% of Mn, 0.02 to 0.2% of P, 0.05% or less of S, 0.03 to 0.2% of Al, 0.01% or less of N, 0.001 to 0.2% of Nb, and 0.0001 to 0.008% of B in such a way that the respective contents of C, Nb, Al, N, Si, Mn and P satisfy the following formulae:

$5 \leqq Nb/C \leqq 30$, $10 \leqq Al/N \leqq 80$, and $16 \leqq (3 \times Si/28 + 200 \times P/31)/(Mn/55) \leqq 40$; Fe remnant; and inevitable impurities, said method comprising the steps of:

performing rolling on said steel material with a total reduction of 50% or more and 95% or less while effecting lubrication thereon in a temperature range of not higher than an $Ar_3$ transformation temperature and not lower than 500° C.;

performing a hot-rolled sheet recrystallization treatment on said steel material by a coiling or annealing process;

performing cold rolling on said steel material with a reduction of 50 to 95%; and then effecting recrystallization annealing on said steel material in a temperature range of 700° to 950° C.

2. A method of producing a high-strength cold-rolled steel sheet excelling in deep drawability according to claim 1, wherein a basic-composition steel is used which contains one or more of the following: 0.1 to 1.5% of Cu, 0.1 to 1.5% of Ni, and 0.01 to 1.5% of Mo.

3. A method of producing a high-strength cold-rolled steel sheet excelling in deep drawability according to claim 1, wherein a basic-composition steel is used which contains 1.0 to 2.0% of Si, 1.5 to 3.0% of Mn, 0.05 to 0.2% of P, and 0.1 to 1.5% of Ni, in such a way as to satisfy the following formulae:

$$2 \times Si + Mn + 20 \times P + Ni \geqq 6$$

$$2.0 \leqq (2 \times Si/28 + P/31)/(Mn/55 + 0.5 \times Ni/59) \leqq 3.5.$$

4. A method of producing a high-strength cold-rolled steel sheet excelling in deep drawability according to claim 1, wherein a basic-composition steel is used which contains 0.005 to 0.06% of Ti and satisfies the formula:

$$48(Ti/48 - N/14 - S/32) \times P \leqq 0.0015.$$

5. A method of producing a high-strength cold-rolled steel sheet excelling in deep drawability according to claim 1, wherein the hot-rolled sheet recrystallization treatment is perforated at a heating rate of not lower than 1° C./s and at an annealing temperature of 700° to 950° C.

6. A method of producing a high-strength cold-rolled steel sheet excelling in deep drawability according to claim 1, wherein the hot-rolled sheet recrystallization treatment is performed in such a way as to satisfy the following formulae:

$$600 \leqq T \leqq 900,$$

and $$T \times t \geqq 3800$$

where T represents annealing temperature (°C.), and t represents annealing time (hr.).

7. A method of producing a high-strength cold-rolled steel sheet excelling in deep drawability according to claim 5, wherein finish hot rolling is started at a temperature not lower than an $Ar_3$ transformation temperature; cooling is performed at a cooling rate of not lower than 20° C./s and at a cooling rate of not lower than 30° C./s to attain a temperature not higher than the $Ar_3$ transformation temperature without performing any other rolling process during said finish hot rolling; and subsequently rolling is performed while effecting lubrication in a temperature range not higher than the $Ar_3$ transformation temperature and not lower than 500° C., with a total reduction in the range not higher than the $Ar_3$ transformation temperature of not less than 50% and not more than 95%.

8. A method of producing a high-strength cold-rolled steel sheet excelling in deep drawability according to claim 5, wherein rough hot rolling and finish hot rolling subsequent thereto are performed as follows:

the ratio of the reduction of the rough hot rolling to the reduction of the finish hot rolling ranges from 0.8 to 1.2; and the rough hot rolling is terminated at a temperature not lower than ($Ar_3$ transformation temperature − 50° C.) and not higher than ($Ar_3$ transformation temperature + 50° C.), the rough hot rolling being performed while effecting lubrication in a temperature range not higher than the $Ar_3$ transformation temperature and not lower than 500° C. with a total reduction of not less than 50% and not more than 95%.

9. A high-strength cold-rolled steel sheet which excels in deep drawability comprising a steel material consisting of: a basic composition including 0.01% or less of C, 0.1 to 2.0% of Si, 0.5 to 3.0% of Mn, 0.02 to 0.2% of P, 0.05% or less of S, 0.03 to 0.2% of Al, 0.01% or less of N, 0.001 to 0.2% of Nb, and 0.0001 to 0.008% of B in such a way that the respective contents of C, Nb, Al, N, Si, Mn and P satisfy the following formulae:

$5 \leqq Nb/C \leqq 30$, $10 \leqq Al/N \leqq 80$, and $16 \leqq (3 \times Si/28 + 200 \times P/31)/(Mn/55) \leqq 40$; Fe remnant; inevitable impurities; and, as needed, one or more of the following: 0.1 to 1.5% of Cu, 0.1 to 1.5% of Ni, and 0.01 to 1.5% of Mo, and having a tensile strength (TS) of 35 kgf/mm$^2$ or more and a lankford value (r-value) which satisfy the formula:

$$r \times TS \leqq 105.$$

10. A method of producing a high-strength cold-rolled steel sheet excelling in deep drawability according to claim 2, wherein a basic-composition steel is used which contains 1.0 to 2.0% of Si, 1.5 to 3.0% of Mn, 0.05 to 0.2% of P, and 0.1 to 1.5% of Ni, in such a way as to satisfy the following formulae:

$$2 \times Si + Mn + 20 \times P + Ni \geqq 6$$

$$2.0 \leqq (2 \times Si/28 + P/31)/(Mn/55 + 0.5 \times Ni/59) \leqq 3.5.$$

11. A method of producing a high-strength cold-rolled steel sheet excelling in deep drawability according to claim 2, wherein a basic-composition steel is used which contains 0.005 to 0.06% of Ti and satisfies the formula:

$$48(Ti/48 - N/14 - S/32) \times P \leqq 0.0015.$$

12. A method of producing a high-strength cold-rolled steel sheet excelling in deep drawability according to claim 2, wherein the hot-rolled sheet recrystallization treatment is performed at a heating rate of not lower than 1° C./s and at an annealing temperature of 700° to 950° C.

13. A method of producing a high-strength cold-rolled steel sheet excelling in deep drawability according to claim 2, wherein the hot-rolled sheet recrystallization treatment is performed in such a way as to satisfy the following formulae:

$$600 \leqq T \leqq 900,$$

and $$T \times t \geqq 3800$$

where T represents annealing temperature (°C.), and t represents annealing time (hr.).

14. A method of producing a high-strength cold-rolled steel sheet excelling in deep drawability according to claim 6, wherein finish hot rolling is started at a temperature not lower than an $Ar_3$ transformation temperature; cooling is performed at a cooling rate of not lower than 20° C./s and at a cooling rate of not lower than 30° C. to attain a temperature not higher than the $Ar_3$ transformation temperature without performing any other rolling process during said finish hot rolling; and subsequently rolling is performed while effecting lubrication in a temperature range not higher than the $Ar_3$ transformation temperature and not lower than 500° C., with a total reduction in the range not higher than the $Ar_3$ transformation temperature of not less than 50% and not more than 95%.

15. A method of producing a high-strength cold-rolled steel sheet excelling in deep drawability according to claim 6, wherein rough hot rolling and finish hot rolling subsequent thereto are performed as follows:

the ratio of the reduction of the rough hot rolling to the reduction of the finish hot rolling ranges from 0.8 to 1.2; and the rough hot rolling is terminated at a temperature not lower than ($Ar_3$ transformation temperature−50° C.) and not higher than ($Ar_3$ transformation temperature+50° C.), the rough hot rolling being performed while effecting lubrication in a temperature range not higher than the $Ar_3$ transformation temperature and not lower than 500° C. with a total reduction of not less than 50% and not more than 95%.

16. A method of producing a high-strength cold-rolled steel sheet excelling in deep drawability according to claim 3, wherein a basic-composition steel is used which contains 0.005 to 0.06% of Ti and satisfies the formula:

$$48(Ti/48 - N/14 - S/32) \times P \leqq 0.0015.$$

17. A method of producing a high-strength cold-rolled steel sheet excelling in deep drawability according to claim 3, wherein the hot-rolled sheet recrystallization treatment is performed at a heating rate of not lower than 1° C./s and at an annealing temperature of 700° to 950° C.

18. A method of producing a high-strength cold-rolled steel sheet excelling in deep drawability according to claim 4, wherein the hot-rolled sheet recrystallization treatment is performed at a heating rate of not lower than 1° C./s and at an annealing temperature of 700° to 950° C.

19. A method of producing a high-strength cold-rolled steel sheet excelling in deep drawability according to claim 3, wherein the hot-rolled sheet recrystallization treatment is performed in such a way as to satisfy the following formulae:

$$600 \leqq T \leqq 900,$$

and $$T \times t \geqq 3800$$

where T represents annealing temperature (°C.), and t represents annealing time (hr.).

20. A method of producing a high-strength cold-rolled steel sheet excelling in deep drawability according to claim 7, wherein rough hot rolling and finish hot rolling subsequent thereto are performed as follows:

the ratio of the reduction of the rough hot rolling to the reduction of the finish hot rolling ranges from 0.8 to 1.2; and the rough hot rolling is terminated at a temperature not lower than ($Ar_3$ transformation temperature−50° C.) and not higher than ($Ar_3$ transformation temperature+50° C.), the rough hot rolling being performed while effecting lubrication in a temperature range not higher than the $Ar_3$ transformation temperature and not lower than 500° C. with a total reduction of not less than 50% and not more than 95%.

* * * * *